US008382685B2

(12) United States Patent
Vaccari et al.

(10) Patent No.: US 8,382,685 B2
(45) Date of Patent: Feb. 26, 2013

(54) ELECTRONIC SAFETY DEVICE FOR SPORT-HELMETS

(75) Inventors: Fred A. Vaccari, Mississauga (CA); Giovanni Gentile, Lorraine (CA)

(73) Assignee: GGF Sports Solutions Inc.

( * ) Notice: Subject to any disclaimer, the term of this patent is extended or adjusted under 35 U.S.C. 154(b) by 948 days.

(21) Appl. No.: 10/597,680

(22) PCT Filed: Feb. 4, 2005

(86) PCT No.: PCT/CA2005/000146

§ 371 (c)(1), (2), (4) Date: Apr. 27, 2007

(87) PCT Pub. No.: WO2005/074735

PCT Pub. Date: Aug. 18, 2005

(65) Prior Publication Data

US 2008/0083054 A1 Apr. 10, 2008

Related U.S. Application Data

(60) Provisional application No. 60/541,749, filed on Feb. 5, 2004.

(51) Int. Cl.
*A61B 5/117* (2006.01)
*A61B 5/103* (2006.01)

(52) U.S. Cl. ..... 600/595

(58) Field of Classification Search ..... 600/300, 600/587, 595, 594; 200/10; 2/410; D29/102, D29/103

See application file for complete search history.

(56) References Cited

U.S. PATENT DOCUMENTS

| | | | | |
|---|---|---|---|---|
| 5,916,181 | A | 6/1999 | Socci et al. | |
| 6,331,168 | B1 | 12/2001 | Socci et al. | |
| 2002/0060633 | A1 | 5/2002 | Crisco, III et al. | |
| 2004/0206609 | A1 * | 10/2004 | Tilley | 200/10 |

FOREIGN PATENT DOCUMENTS

| | | | |
|---|---|---|---|
| JP | 2000055656 | A * | 2/2000 |
| WO | WO 02091001 | A1 * | 11/2002 |

OTHER PUBLICATIONS

English translation of JP2000-055656A Abstract, Feb. 25, 2000.*
English translation of JP2000-055656A Specification, 4 pages, Feb. 25, 2000.*

* cited by examiner

*Primary Examiner* — Brian Szmal

(57) ABSTRACT

Some embodiments of the invention provide an electronic safety device, adapted for use in a helmet suitable for an impact-sport, which operates to warn a first participant that a head inside the helmet is in an unsafe position relative to a body coupled to the head. In some embodiments, the head may belong to the first participant, in which case the first participant is warned of their own unsafe head position. Alternatively and/or additionally, the head may belong to a second participant, in which case the first participant is warned of the unsafe head position of the second participant. In very specific embodiments the electronic safety includes a sensor that senses head position and provides corresponding readings, and a processor that interprets the reading of the sensor in order to determine whether or not to produce a signal that indicates that the head is in an unsafe position.

4 Claims, 5 Drawing Sheets

ELECTRONIC SAFETY DEVICE FOR SPORT-HELMETS

This application claims the benefit of U.S. Provisional Application No. 60/541,749, filed on Feb. 5, 2004, and the entire contents of which is hereby incorporated by reference.

FIELD OF THE INVENTION

The invention relates to a safety system for use during impact-sports, and in particular, to an electronic device for sport-specific helmets.

BACKGROUND OF THE INVENTION

There are a number of sports in which participants frequently experience hard collisions and/or falls. These sports are generally considered impact-sports (or high-impact sports) and include, for example, hockey, football, lacrosse, downhill skiing, snowboarding and short-track speed skating. A participant of such an activity may suffer severe neck and other related injuries as a result of having his/her head in an unsafe position. For example, the head of a participant may be tilted too far forward, relative to the body, at a moment of impact. Learning to maintain an appropriate head angle during these types of activities must be taught to young and/or inexperienced participants that would otherwise typically have the tendency to put their heads down when learning the particular activity.

During the game of football (American rules, e.g. as in the NFL™), for example, position-players such as running-backs, safeties, and linebackers receive and deliver forceful tackles and blocks. In such maneuvers it is essential that a player keep their head up and not down, or else suffer the risk of spinal injury upon impact. Young and/or inexperienced football players must be taught to keep their heads up relative to their bodies, as it is the natural tendency for inexperienced players to lower their heads.

In a similar example, during the game of hockey a player that tends to tilt his head downward relative to his body, might suffer a serious injury during a collision that he was unprepared for because he was unaware of the game around him. The unsafe head position, at the moment of impact, may even result in severe spinal damage. This risk increases during play near the boards, where accidental and/or purposeful cross-checking is common.

By contrast, non-impact or low-impact sports (e.g. golf, baseball and the like) are rarely, if ever, associated with severe spinal injuries stemming from a forceful collision. Participants in such activities maintain a relatively stationary position and it is easier to track their movement to develop idealized swing movements. Accordingly, electro-mechanical systems for non-impact or low-impact activities have been developed to serve as teaching aids to help participants improve a swing. The complexity of these systems tends to restrict their use to practice situations, since the equipment cannot be integrated into a form that would make it easy for a player to manage during a real-game situation. Moreover, such systems are generally considered illegal aids in real-game situations due to their bulk.

U.S. Pat. Nos. 6,048,324, 5447,305, 5,428,846, and 5,380,001 all to Socci et al. are specific examples of complex electro-mechanical systems that are employed as teaching aids specifically for use in batting practice for baseball. The systems include components such as accelerometers, gyroscopes, fragile mercury sensors, motors, and linking mechanisms that are employed to measure motion, momentum and angular forces. Additionally, these systems, as described, require external connections that simply cannot be safely allowed in impact-sports like hockey because they would be hazardous to other players. A helmet including such a system would be deemed unsafe for use in a game like hockey by organizations, such as the American Standards Association™, that provide strict specifications for the design of sport-specific helmets.

SUMMARY OF THE INVENTION

According to an aspect of an embodiment of the invention there is provided an electronic safety device, for use in a sport-specific helmet for protecting the head of a first participant of an impact-sport, having: a position sensor for sensing the position of the head of the first participant and providing a signal indicative of the sensed head position; a processor connectable to the position sensor for receiving the signal indicative of the sensed head position, the processor determining if the head of the first participant has been in an unsafe position for a first continuous duration of time, and producing a signal qualifying the determination; and, an indicator connectable to the processor for receiving the signal qualifying the determination, and subsequently indicating that the head of the first participant is in an unsafe position.

In some embodiments an activator is included for switching the electronic safety device between an active mode, in which the electronic safety device operates to monitor of the head position of the first participant, and a standby mode, in which the electronic safety device does not monitor of the head position of the first participant. In such embodiments, the activator is at least one of a toggle switch, a photo-switch and a motion detector. The activator may also include an automatic turn-off system for switching the electronic safety device from the active mode to the standby mode.

In some embodiments the electronic safety device includes a power connector for delivering power to at least one of the processor, the position sensor and the indicator. In such embodiments, the power connector may include a connection to at least one of a battery housing and a solar cell.

In some embodiments the indicator includes at least one of an audible indicator, a visual indicator and a vibration indicator.

In some embodiments, the processor further determines if the head of the first participant has been in an unsafe position for a second continuous duration of time, which is longer than the first continuous duration of time, and producing a signal for the indicator to stop indicating if the head has been in the unsafe position for the second continuous duration of time.

According to another aspect of an embodiment of the invention there is provided a method for warning at least one of first and second participants of an impact-sport that the head of the first participant is in an unsafe position. The method includes the steps of: sensing an unsafe head tilt of the first participant; determining if the sensed unsafe head tilt has been maintained for at least a first continuous duration of time; and, indicating to one of the first and second participants that the head tilt of the first participant is unsafe. In some embodiments, the method also includes the step of stopping the indicating after a second continuous duration of time. In some embodiments, the method also includes the step of stopping the sensing, determining and indicating after a second continuous duration of time. In some such embodiments, the method includes the step of re-starting the sensing, determining and indicating after a third continuous duration of time.

According to another aspect of an embodiment of the invention, there is provided a method according to for operating electronic safety device for use in a sport-specific helmet adapted to protect the head of a first participant of an impact-sport. The method includes: determining whether or not the electronic safety device is in use; and one of switching on and maintaining an active mode for the electronic safety device, if it is determined that the electronic safety device is in use. In some embodiments, the method also includes the step of one of switching off and maintaining a standby mode for the electronic safety device, if it is determined that the electronic safety device is not in use. In some embodiments, the step of determining whether or not the electronic safety device is in use includes a determining if sufficient ambient light is being received from he surrounding environment; or, determining whether or not the electronic safety device is in use includes a determining if the electronic safety device is in motion.

According to yet another aspect of an embodiment of the invention, there is provided a sport-specific helmet, suited for use in an impact-sport, having: a shell providing a main cavity adapted to fit around a human head; a layer of padding lining the inside of the main cavity of the shell; and an electronic safety device for determining and indicating that a head of a wearer of the helmet is in an unsafe position.

Other aspects and features of the present invention will become apparent, to those ordinarily skilled in the art, upon review of the following description of the specific embodiments of the invention.

BRIEF DESCRIPTION OF THE DRAWINGS

For a better understanding of the present invention, and to show more clearly how it may be carried into effect, reference will now be made, by way of example, to the accompanying drawings, which illustrate aspects of embodiments of the present invention and in which.

DETAILED DESCRIPTION OF THE INVENTION

A device for warning a participant of an impact-sport that a head is in an unsafe position has not, until now, been feasible due to a number of complications that these types of sports inherently inject into the problem of designing such a device. Examples of such complications include, without limitation, the fact that participants of such activities may be expected to or will likely: experience numerous forceful collisions and/or falls (e.g. body-checks, tackles, high-speed falls); be in a state of relatively constant motion; and, move their heads in unpredictable patterns in order to gain information about the game and/or field of play.

Despite the aforementioned obstacles, some embodiments of the invention provide an electronic safety device, adapted for use in a helmet suitable for an impact-sport, which operates to warn a first participant that a head inside the helmet is in an unsafe position relative to a body coupled to the head. In some embodiments, the head may belong to the first participant, in which case the first participant is warned of their own unsafe head position. Alternatively and/or additionally, the head may belong to a second participant, in which case the first participant is warned of the unsafe head position of the second participant. In very specific embodiments the electronic safety device includes a sensor that senses head position and provides corresponding readings, and a processor that interprets the reading of the sensor in order to determine whether or not to produce a signal that indicates that the head is in an unsafe position.

Figure 1:
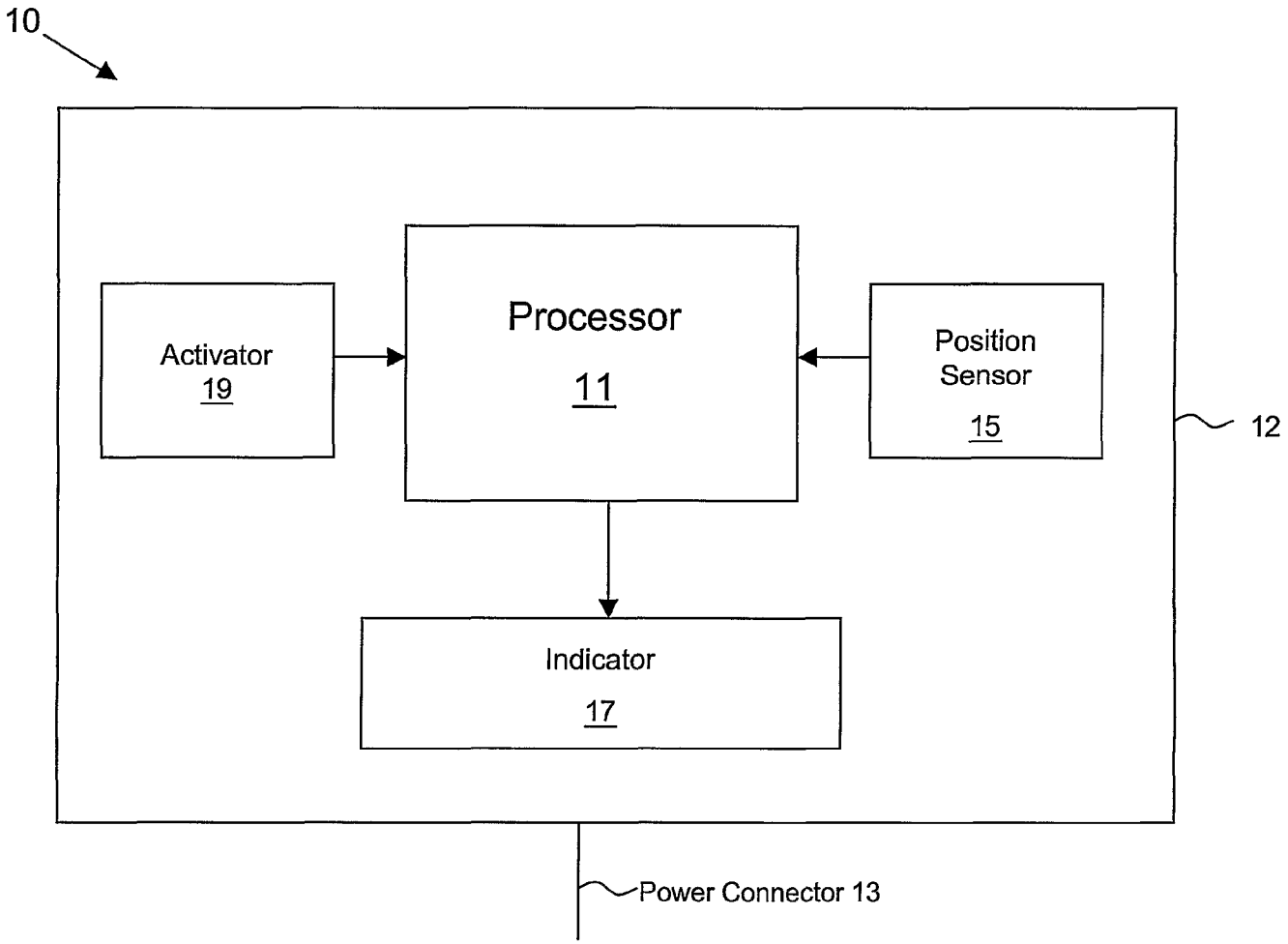
FIG. 1 is a simplified schematic drawing of an electronic safety device according to one very specific embodiment of the invention.

Referring to FIG. 1, shown is a simplified schematic drawing of an electronic safety device 10 according to one very specific embodiment of the invention. The electronic safety device 10 includes a processor 11, a position sensor 15, an indicator 17 and an activator 19. The aforementioned components 11, 15, 17, and 19 are assembled on a printed circuit board 12 that includes a power connector 13.

The processor 11 is coupled to receive signals from the position sensor 15 and the activator 19, and coupled to deliver a signal to the indicator 17. Alternatively and/or additionally, the processor 11 may optionally deliver a signal to at least one of the position sensor 15 and the activator 19, and/or receive a signal from the indicator 17.

In some embodiments, the power connector 13 is coupled to each of the components 11, 15, 17 and 19 directly and/or through an intervening one of the other components 11, 15, 17 and 19. The power connector 13 is also connectable to a power source such as a battery, solar cell or the like. In some embodiments, the power connector 13 is adapted to snugly hold a coin cell or other low voltage miniature battery (not shown), such as, for example, a 3V lithium coin cell battery. In other embodiments, the power connector 13 includes a wire trace and solder-connection to a solar cell (not shown). Alternatively and/or additionally the power connector 13 may be adapted to house a small battery and also include a solar-cell or similar photo-activated device to charge the battery when a portion of the electronic safety device 10 is exposed to a suitable light source (e.g. arena lights, sunshine, etc.). Those skilled in the art will appreciate that numerous other variations for the power connector 13 are possible.

In some embodiments, the processor 11 is a suitable combination of hardware, firmware and software. In one specific embodiment the processor 11 is a microcontroller chip, such as for example, the Atmel Tiny12V™. This type of microcontroller typically requires 1.8V to 5V DC, and includes 1K Byte of flash programmable memory, 64 Bytes of EEPROM memory, and factory provided system-operating logic.

Figure 2:
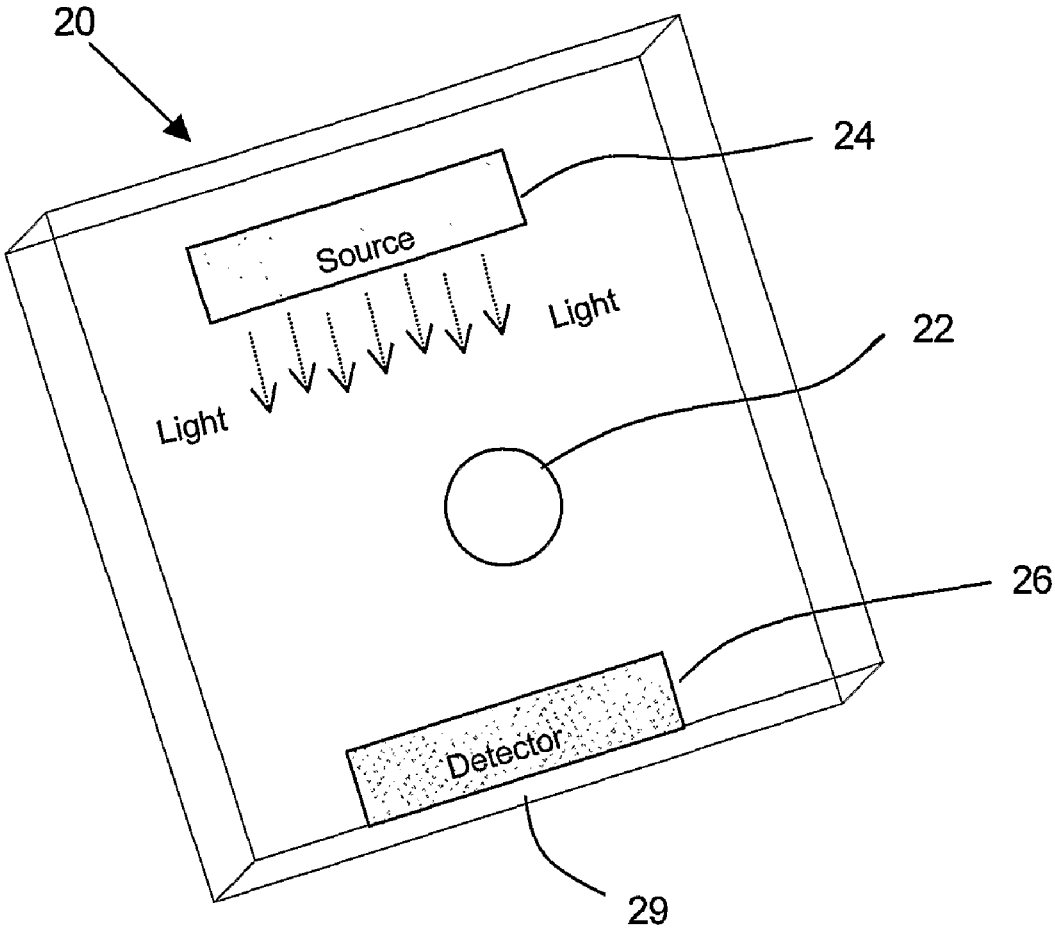
FIG. 2 is a perspective view of a photo-interrupter suited for use as an sensor in the electronic safety device shown in FIG. 1.

In some embodiments, the position sensor 15 is operable to sense a tilt angle relative to a vertical axis extending from a straight spine of a wearer of a helmet including an electronic safety device 10. That is, the position sensor 15 is operable to sense how far forward and/or backward the head is relative to the body of the wearer. Referring to FIG. 2, and with continued reference to FIG. 1, in some specific embodiments the position sensor 15 is a photo-interrupter 20 that is operable to sense tilt past a threshold angle (e.g. 70°) relative to a vertical axis (e.g. extending from a substantially straight spine, when the participant is standing upright). When the head tilts forward past the threshold angle the photo-interrupter 20 outputs a voltage level change that is received by the processor 11 that in turn determines whether or not the head has been tilted past the threshold angle for a predetermined duration, as will be described in more detail below with added reference to FIG. 5. Suitable alternate sensing devices may include a piezo element and/or Hall-Effect switch in combination with a moving object such as a steel ball or gravity sensitive switch. In view of this description and the examples presented herein, those skilled in the art are expected to be able to substitute in other suitable sensing devices to achieve the desired result.

With specific reference to FIG. 2, in one embodiment the photo-interrupter 20 includes a small ball 22, a photo-source 24 (e.g. a Light Emitting Diode) and photo-detector 26 which are all enclosed in a small (e.g. 2 mm×2 mm) housing 29. In a first position, before the threshold angel, the photo-detector 26 is able to detect light generated by the photo-source 24. In a second position, equal or beyond the threshold angle, the ball 22 moves between the photo-source 24 and the photo-detector 26, subsequently blocking the light path between the two resulting in a voltage level change in the photo-detector 26. The voltage level change is the output signal from the photo-interrupter 20 that can be coupled to a processor. When the photo-interrupter 20 is returned to the first position the ball 22 moves out of the light path between the photo-source 24 and photo-detector 26, once again allowing the photo-detector 26 to detect the light generated by the photo-source 24, and thus reversing the voltage level change.

By contrast, the systems described in the Socci et al. patents use an overly sensitive mercury tilt switch in which the mercury inside the switch sloshes around in response to every movement producing erratic signals for players that are not relatively still. Given the nature of impact-sports, such as hockey and football, where the head of a participant is in relatively constant and unpredictable motion during play, such a device would be unsuitable because the erratic signals produced would cause a high number of false activations.

In some embodiments, the indicator 17 is operable to provide a signal to either the wearer of a helmet including the electronic safety device 10 and/or another person and/or another electronic device. For example, the indicator 17 may provide at least one of an audible alarm signal, a vibration, a colored-light and a data signal.

More specifically, an audible alarm indicator such as a piezo beeper and/or pre-recorded message loop such as "heads up" may be used to provide an audible signal. A problem with an audible alarm indicator is that given the loud ambient noise during a real game scenario (e.g. in a hockey arena) the player may have difficulty hearing the alarm. If the volume is increased the audible alarm indicator may annoy and/or cause discomfort, and in the worst case, be removed or intentionally damaged by the wearer. Another suitable device might be a vibrating alarm that gently vibrates when the head is in a dangerous downward position, although implementation could require a larger power source. Alternatively and/or additionally, a visual alarm indicator such as one or more Light Emitting Diodes (LED) is often less expensive, draws relatively less power and is small, but is difficult to position so that the wearer can see the LED without it becoming a distraction. The benefit is to provide other players with an indicator that the wearer has his/her head in an unsafe position so that they may be cautious around the wearer.

In one very specific embodiment, the indicator 17 is a combination of a low intensity audible alarm for the wearer and a LED visual indicator for other players (coaches, referees, etc.). This arrangement allows the wearer to be warned and reminded to put his/her head up and warns other players to be less aggressive and more cautious around the wearer when his/her head is in an unsafe position, thus possibly resulting in significantly fewer injuries to both players. Referees may also use the LED visual indicator to determine if certain collisions (hits, body-checks, etc.) were as a result of unsportsmanlike conduct on the part of a player that was in a position to see the LED visual indicator, but nevertheless proceeded in an overly aggressive manner.

In some embodiments, the activator 19 is operable to provide a signal to switch the electronic safety device 10 to an active-mode from a standby mode and/or vice versa. That is, in some embodiments, the activator 19 is an enabling device to activate the processor 11. Additionally, an automatic turn-off system and method may be included in the activator 19. In one specific embodiment the activator 19 includes a toggle switch that is manipulated by a wearer (or another) to turn on/off the electronic safety device. In another specific embodiment, the activator includes a photo-switch that outputs a signal to activate the electronic safety device 10 when there is a suitable amount of light present (e.g. from arena lights). Alternatively and/or additionally, the activator includes a motion sensor (e.g. PID sensor) that is operable to signal the electronic safety device 10 to switch into an active mode when the electronic safety device 10 is worn by a player in motion. device when it senses player motion. The output of activator 19 would be a signal that would activate the processor 11, which would in turn initiate monitoring of the head position of the wearer.

Figure 3:
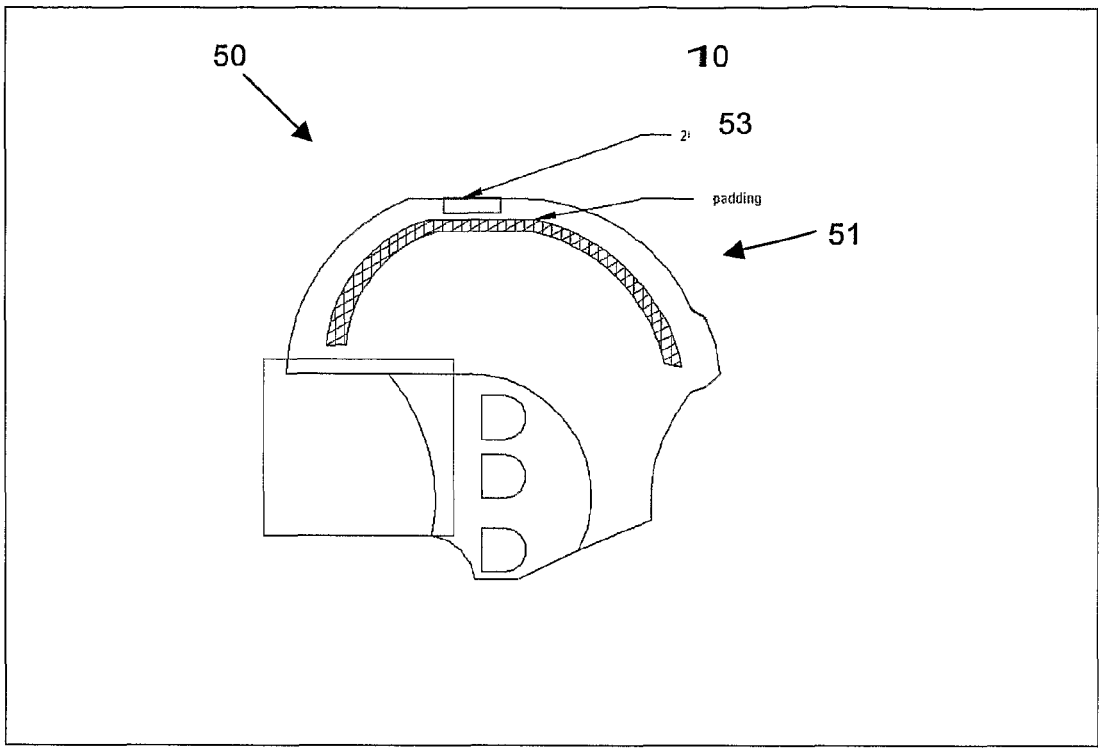
FIG. 3 is a side-view of an improved hockey helmet in combination with the electronic safety device of FIG. 1, according to a specific embodiment of the invention.

Referring to FIG. 3, shown is a side view of an improved hockey helmet 50 in combination with the electronic safety device 10 of FIG. 1, according to a specific embodiment of the invention. Once installed the electronic safety device 10 functions without additional effort from the wearer. In this specific embodiment, the electronic safety device 10 is mounted on top of the helmet 50 between the helmet shell 51 and padding 53. In this position, the photo-switch and/or motion-switch options for the activator 19 are preferred because they permit use of the electronic safety device 10 without manual activation by the wearer (who might forget to turn it on or leave it off intentionally/unintentionally).

The electronic safety device 10 is preferably contained in a small, lightweight plastic and/or polymer housing. In some embodiments the casing is soft and gel-like, but firm enough to protect the electronic safety device 10. The electronic safety device 10 in the housing may be attached to the helmet 50 using a suitable fastener, such as for example, and without limitation, Velcro™, snaps, pop-rivets, adhesives, double-side tape and the like.

In a specific embodiment, the housing—containing the circuit board, electronic components and a battery—is made of impact resistant and fire retardant material such as a polycarbonate. In some embodiments, the top of the housing includes a hole to allow ambient light to reach a photo-switch.

Figure 4:
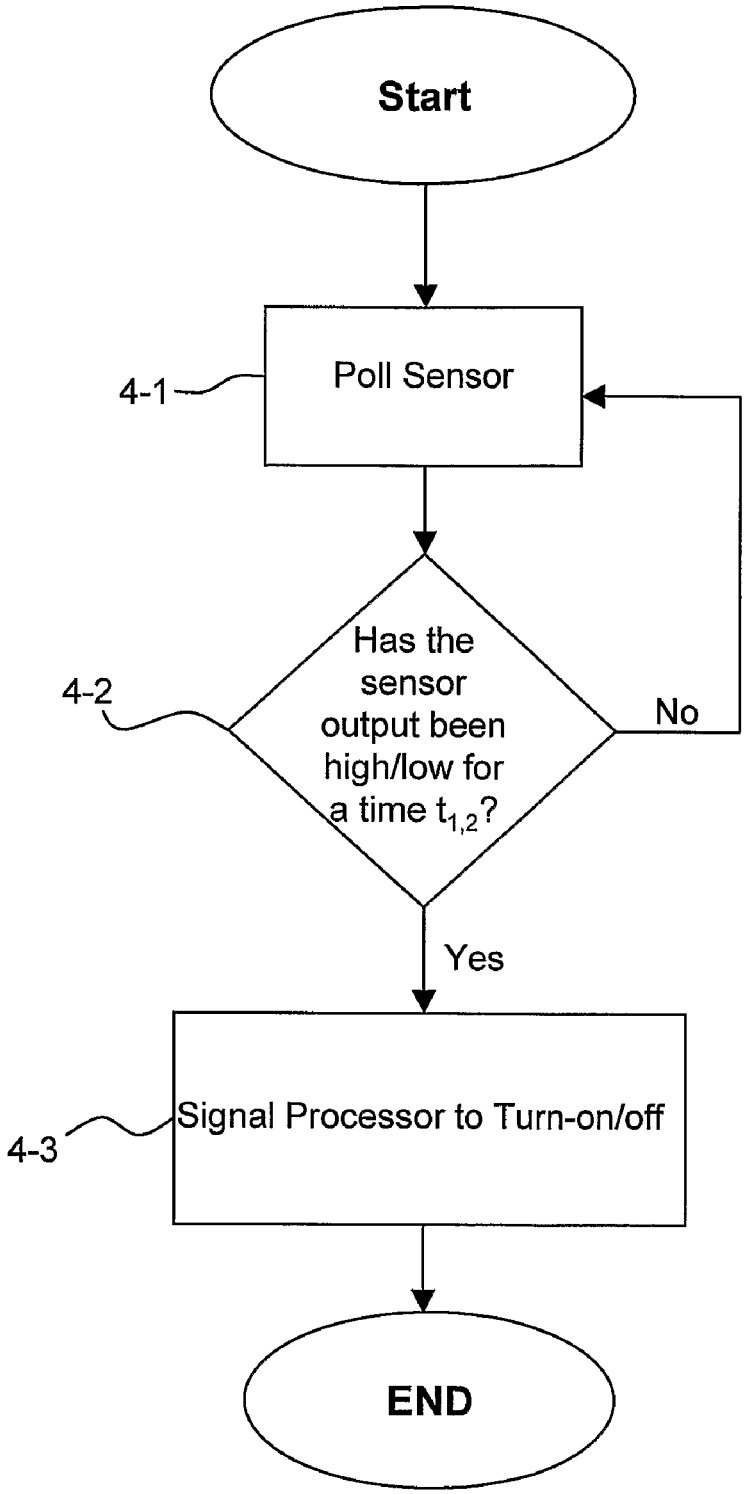
FIG. 4 is a flow chart illustrating a very specific first method of operation for the electronic safety device shown in FIG. 1, according to an embodiment of the invention.

Referring to FIG. 4, shown is a flow chart illustrating an activation method for the electronic safety device 10 shown in FIG. 1, according to an embodiment of the invention. At step 4-1 an activation sensor is polled. In some embodiments, as described above the activation sensor is a photo-switch that produces a first (high) signal when ambient light is detected and a second (low) signal when no ambient light is detected.

At step 4-2 it is determined whether or not the activation sensor (e.g. the photo-switch) has outputted a signal, which is indicative of a positive indicator to turn the electronic safety device 10 on, for a first continuous duration of time $t_1$. If the positive indicator has not been present for at least the time $t_1$ (no path, step 4-2), then step 4-1 is repeated. On the other hand, if the positive indicator has been present for at least the time $t_1$ (yes path, step 4-2), then an activation signal is sent to the processor 11 at step 4-3. For example, a positive indicator is the detection of ambient light for at least one minute.

A similar method can be used to turn off the electronic safety device 10. In fact, in some embodiments, the steps for the two methods may occur together. In such a case, it is also determined at step 4-2 whether or not the positive indicator has been absent for a second continuous duration of time $t_2$ (e.g. 3 minutes) and a de-activation signal is sent processor 11 at step 4-3 thereafter. Thus, a user, with a helmet 50 including the electronics safety device 10, does not have to remember to manually activate or deactivate the electronic safety device 10. This may conserve power and extend battery life in addition to automatically turning the electronic safety device 10 on during normal use of the helmet 50. In the specific case that the activation sensor is a photo-switch, the assumption here is that the helmet 50 is in the equipment bag or the photo-switch is otherwise shielded from light when the helmet 50 is not being used. Additionally and/or alternatively, the activator 19 and/or processor 11 also function to monitor a battery voltage and then signal the indicator 17 to indicate when the battery voltage becomes low.

Figure 5:
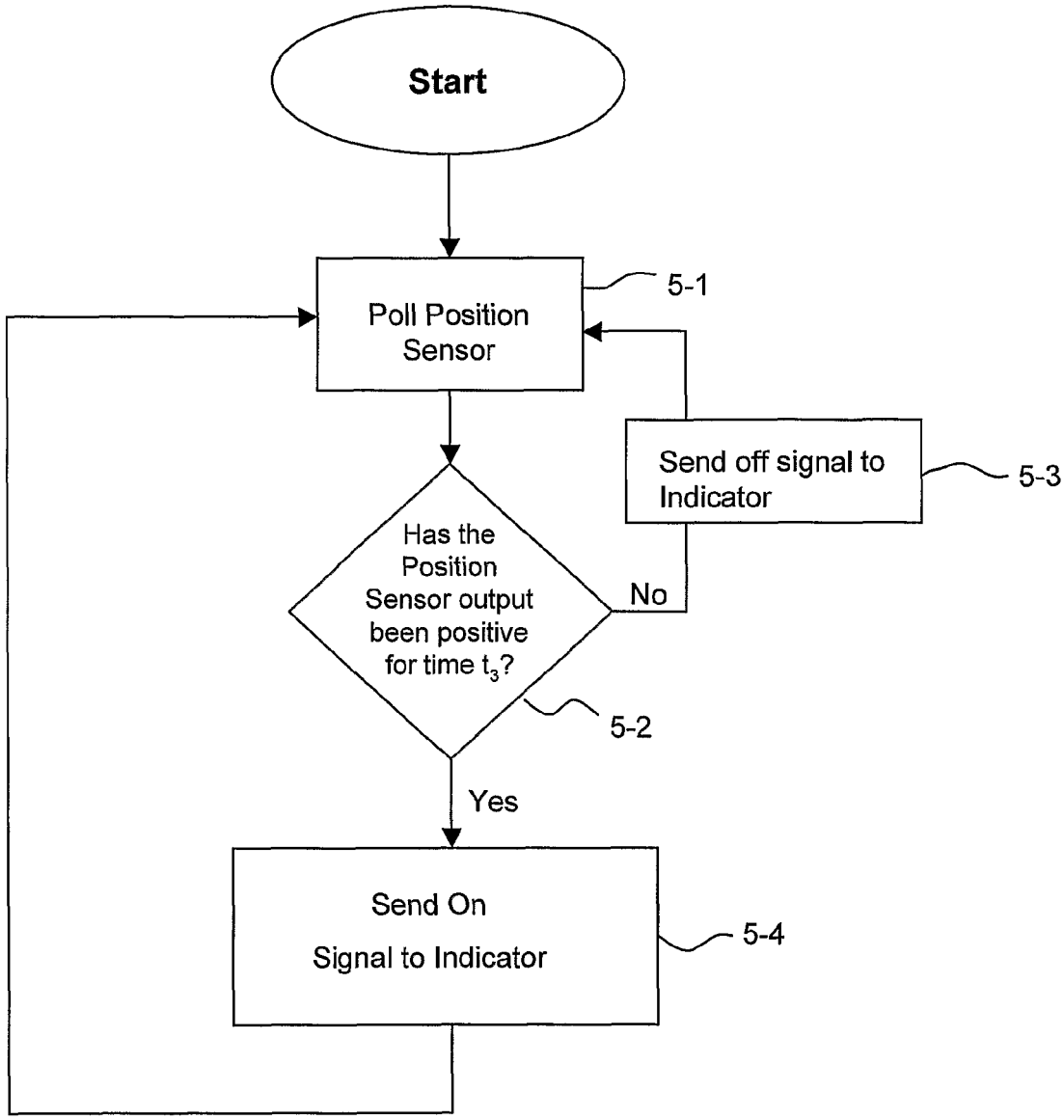
FIG. 5 is a flow chart illustrating a very specific second method of operation for the electronic safety device shown in FIG. 1, according to an embodiment of the invention.

Referring to FIG. 5, shown is a flow chart illustrating an active operating method for the electronic safety device 10 shown in FIG. 1, according to an embodiment of the invention. At step 5-1 the position sensor 15 is polled.

Subsequently, at step 5-2 it is determined whether or not the position sensor 15 has outputted a signal, which is indicative of a positive indicator of an unsafe angle, for a third continuous duration of time $t_3$ (e.g. 500 milliseconds). If the positive indicator has not been present for at least the time $t_3$ (no path, step 5-2), then an off signal is sent to the indicator 17 at step 5-3, and step 5-1 is repeated. On the other hand, if the positive indicator has been present for at least the time $t_3$ (yes path, step 5-2), then an on signal is sent to the indicator 17 at step 5-4. That is, in one embodiment there is a 500 msec delay before an indicating alarm is initiated to prevent false alarms when a player momentarily puts his/her head down. After the indicating alarm has been triggered, the indicating alarm will continue as long as the player has his/her head in an unsafe position.

Additionally and/or alternatively, for situations where a player might be down for several seconds or minutes, the indicator is signaled to shutoff after a fourth time $t_4$ (e.g. 2 minutes). In such embodiments, the electronic safety device 10 is reset only after the player gets up.

While the above description provides example embodiments, it will be appreciated that the present invention is susceptible to modification and change without departing from the fair meaning and scope of the accompanying claims. Accordingly, what has been described is merely illustrative of the application of aspects of embodiments of the invention. Numerous modifications and variations of the present invention are possible in light of the above teachings. It is therefore to be understood that within the scope of the appended claims, the invention may be practiced otherwise than as specifically described herein.

We claim:

1. An electronic safety device in a sport-specific helmet for protecting the head of a first participant of an impact-sport, when the head is tilted beyond a threshold unsafe position and comprising:

(a) a position sensor in the helmet for sensing when the position of the head of the first participant is tilted beyond a threshold unsafe position and providing a signal indicative of the sensed unsafe head position;

(b) a processor in the helmet connected to the position sensor for receiving the signal indicative of the sensed head position, the processor incorporating means operable to determine if the head of the first participant has been in the unsafe position for a first continuous duration of time, and further being operable to generate a signal qualifying the determination, after said first continuous duration of time ; and, (c) an indicator in the helmet connected to the processor for receiving the signal qualifying the determination, and subsequently indicating that the head of the first participant is in an unsafe position;

(d) processor further incorporating means operable to determine when the head of the first participant has been in an unsafe position for a second continuous duration of time, which is longer than the first continuous duration of time; and, (e) said processor being operative to generate a stop signal to said indicator indicating that said second duration of time is longer than said first duration of time , and stopping said indicator from indicating that the head has been in the unsafe position for the second continuous duration of time.

2. An electronic safety device according to claim 1 further comprising an activator for switching the electronic safety device between an active mode, in which the electronic safety device operates to monitor the head position of the first participant, and a standby mode, in which the electronic safety device does not monitor of the head position of the first participant.

3. An electronic safety device according to claim 1, including a piezo element operable to create an alarm.

4. An electronic safety device according to claim 1, wherein the indicator includes at least one indicator selected from the group comprising an audible indicator, a visual indicator and a vibration indicator.

* * * * *